US008701749B2

(12) United States Patent
Cieslik et al.

(10) Patent No.: US 8,701,749 B2
(45) Date of Patent: Apr. 22, 2014

(54) EVAPORATOR FOR A REFRIGERATOR AND METHOD FOR THE PRODUCTION THEREOF

(75) Inventors: Detlef Cieslik, Giengen (DE); Thorsten Kusnik, Guenzburg (DE); Berthold Pflomm, Ulm (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1480 days.

(21) Appl. No.: 11/628,727

(22) PCT Filed: Jun. 7, 2005

(86) PCT No.: PCT/EP2005/052602

§ 371 (c)(1),
(2), (4) Date: Dec. 5, 2006

(87) PCT Pub. No.: WO2005/121662

PCT Pub. Date: Dec. 22, 2005

(65) Prior Publication Data

US 2008/0066489 A1 Mar. 20, 2008

(30) Foreign Application Priority Data

Jun. 7, 2004 (DE) ..... 10 2004 027 706

(51) Int. Cl.
*F28F 1/32* (2006.01)
*B21D 53/08* (2006.01)

(52) U.S. Cl.
USPC ..... 165/171; 29/890.035

(58) Field of Classification Search
USPC ..... 165/168, 171; 62/515; 29/890.035
See application file for complete search history.

(56) References Cited

U.S. PATENT DOCUMENTS

| | | | | |
|---|---|---|---|---|
| 2,795,035 | A * | 6/1957 | Kafer | 29/890.038 |
| 3,698,475 | A * | 10/1972 | Beck, Jr. | 165/171 |
| 3,834,458 | A | 9/1974 | Bilbro et al. | |
| 4,023,557 | A * | 5/1977 | Thorne et al. | 126/677 |
| 4,074,406 | A * | 2/1978 | Boyd et al. | 29/890.033 |
| 4,700,870 | A * | 10/1987 | Schleicher et al. | 222/63 |
| 2002/0144808 | A1 * | 10/2002 | Jones | 165/173 |
| 2004/0112529 | A1 * | 6/2004 | Karlsson et al. | 156/306.6 |
| 2005/0161205 | A1 * | 7/2005 | Ashe et al. | 165/168 |
| 2005/0167863 | A1 * | 8/2005 | Bharadwai et al. | 264/1.1 |

FOREIGN PATENT DOCUMENTS

| | | |
|---|---|---|
| DE | 199 38 773 | 2/2001 |
| EP | 0 222 176 | 5/1987 |
| GB | 2090775 A | 7/1982 |
| JP | 64-19185 | 1/1989 |

(Continued)

OTHER PUBLICATIONS

"Bead", The American Heritage Diction of the English Language, Houghton Mifflin Harcourt Publishing Company, 2010.*

(Continued)

*Primary Examiner* — Teresa Walberg
(74) *Attorney, Agent, or Firm* — Nixon & Vanderhye, P.C.

(57) ABSTRACT

A method for producing a heat exchanger, a) a coolant pipe and a blank are provided; b) a bead that is made of a plastic adhesive is placed between the coolant pipe and the blank so as to extend in a manner that is adapted to the shape of the coolant pipe; and c) the bead located between the coolant pipe and the blank is compressed.

17 Claims, 2 Drawing Sheets

(56) References Cited

FOREIGN PATENT DOCUMENTS

Figure 1:
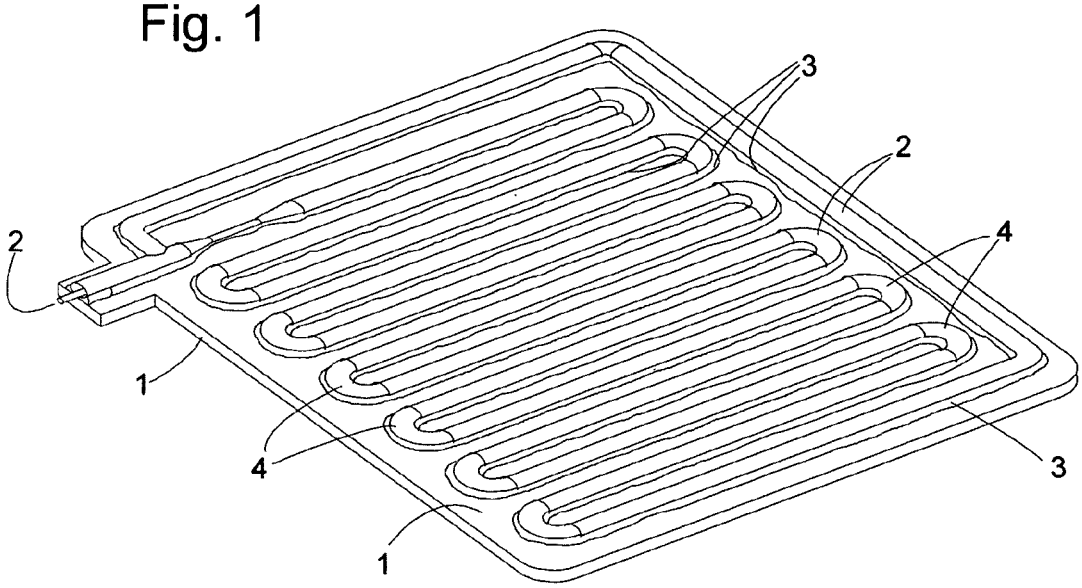

| | | |
|---|---|---|
| JP | 10-19185 A | 1/1998 |
| WO | 8103028 | 10/1981 |
| WO | WO 98/35191 | 8/1998 |
| WO | WO 02/103262 | 12/2002 |
| WO | WO 03/091637 | 11/2003 |

OTHER PUBLICATIONS

International Search Report PCT/EP2005/052602.
The Brockhaus Encyclopedia vol. 4.
The Brockhaus Encyclopedia vol. 21.
Clemens J.M. Lasance, The thermal conductivity of rubber/elastomers, www.electronics-cooling.com, Nov. 2001.

* cited by examiner

EVAPORATOR FOR A REFRIGERATOR AND METHOD FOR THE PRODUCTION THEREOF

The present invention relates to an evaporator for a refrigerator comprising a blank, a coolant pipe and a layer of adhesive connecting the coolant pipe to the blank as well as a method for producing such an evaporator.

An evaporator of this type and a method for the production thereof are known from DE 199 38 773 A1. In the known production method, a meander-shaped bent pipe is held pressed against a blank and the intermediate spaces between the meanders of the pipe are filled with an adhesive. This adhesive can comprise expanded PU foam or pourable thermosetting plastic. A foam is particularly advantageous as adhesive if the evaporator is to be installed as a so-called cold-wall evaporator, i.e. the evaporator is embedded between an inner container of the refrigerator and a thermal insulation layer surrounding the inner container and heat exchange is nevertheless desirable only via the surface of the blank facing the inner container but not via its rear side bearing the coolant pipe. Potting using a non-foamed thermosetting plastic requires a considerable expenditure of material and is therefore costly.

It is also known to secure the coolant pipe on the blank using a double-sided adhesive tape attached between the two. In this technique, however, the adhesive tape impedes heat exchange between the coolant pipe and blank and thus impairs the efficiency of the evaporator.

Known from DE 102 18 826 A1 is an evaporator in which the coolant pipe is secured on the blank using a bitumen film which is laid on the blank and coolant pipe, heated and pressed so that the plastic bitumen material penetrates as a result of the heating into the gusset formed between the blank and the coolant pipe and provides a large-area adhesive bond between the two. With this technique, however, it is difficult to ensure that the air is completely expelled from the gussets so that remaining air pockets impair the heat exchange and can thus result in fluctuating efficiencies of different heat exchangers.

It is the object of the present invention to provide a method for producing a heat exchanger or a heat exchanger which can be produced using such a method which ensures efficient and reproducible heat exchange between the coolant pipe and supporting blank of the coolant pipe by simple means.

The object is firstly achieved by a method comprising the steps of claim 1.

By placing the adhesive bead having a profile adapted to the profile of the coolant pipe between the coolant pipe and the blank, it is ensured that large-area contact between said adhesive and the coolant pipe on the one hand and between said adhesive and the blank on the other hand can be produced using a small amount of adhesive, via which intensive heat exchange takes place between coolant pipe and blank. As a result of compressing the bead between the coolant pipe and the blank, the adhesive is expelled from the immediate contact area between pipe and blank so that optimal heat transfer is possible at this location.

The adhesive is preferably applied to the coolant pipe before the compression since this ensures that the bead comes to lie over its total length between the coolant pipe and the blank.

During compression of the bead, the coolant pipe is preferably flattened at the same time in order to thereby enlarge the region of direct contact between the coolant pipe and the blank or to keep the thickness of the adhesive layer on both sides of the contact region as small as possible and to make the surfaces of the coolant pipe and blank wetted by the adhesive as large as possible.

A butyl rubber is particularly preferable as adhesive. This material is distinguished by an extremely low water absorption and permeability and thus prevents moisture from collecting at the interfaces between the adhesive and the pipe or the blank and impairing the coherence and therefore the thermal conductivity of the evaporator by freezing. In addition, by using butyl rubber with its good heat conduction properties compared to other adhesives, good heat transfer is produced between the blank and the coolant-carrying pipe. The good adhesive properties of the butyl rubber also ensure a very strong bond between the coolant-carrying pipe and the supporting blank connected to the pipe which is used to release cold, so that the pipe is securely and permanently joined to the blank and can be subjected to high mechanical loading. The food-safe properties of butyl also make it possible to use the heat exchanger in the user access region but particularly as an evaporator in the interior of a refrigerator or freezer. By using butyl rubber as adhesive, both flat heat exchangers such as so-called plate evaporators or rear-wall liquefiers and also three-dimensional heat exchangers such as so-called box evaporators and C-shaped evaporators as well as so-called coil evaporators can be produced with good manufacturing success on a large scale.

Another important advantage of this material is that it can be loaded immediately after application. It is not necessary to wait for the material to cure after compression so that the residence time of the evaporator in a press used for this purpose can be kept short and the productivity of the press is accordingly high.

FIG. 1 is a perspective view of a heat exchanger according to the invention, for the example of an evaporator; and FIGS. 2-5 each show a schematic section through parts used to produce the evaporator or the finished evaporator in various phases of production.

The evaporator shown in perspective view in FIG. 1 is composed of a flat blank 1 made of aluminum sheet on which a coolant pipe 2 also consisting of aluminum is arranged in a meander shape. Blank 1 and pipe 2 are held together by butyl rubber which extends between pipe 2 and blank 1 on both sides of a line at which pipe 2 and blank 1 are in contact with one another.

Figure 2:
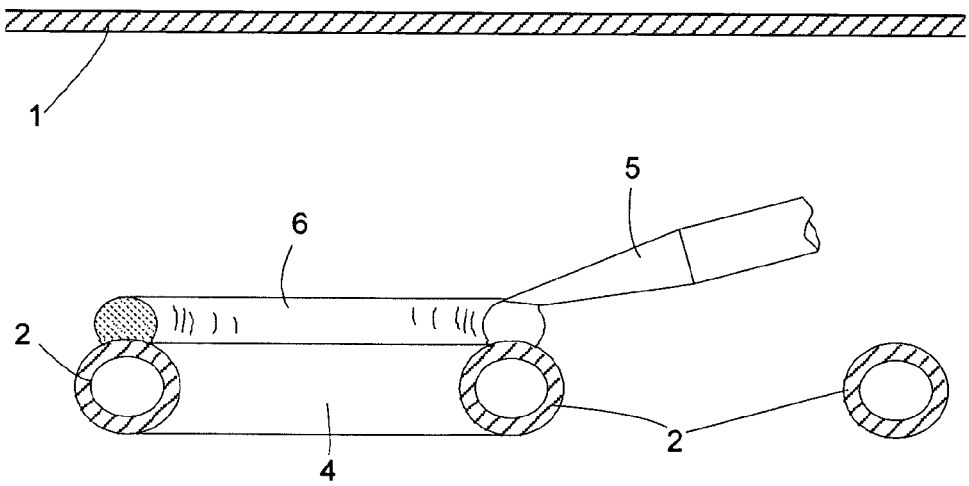

FIG. 2 shows the coolant pipe 2 and the blank 1 in a first stage of the production of the evaporator, cut in a vertical plane to a rectilinear section of the meander-shaped preformed pipe 2. Three sections through the pipe 2 can be seen in the figure; these are circular and a connecting pipe bend 4 can be seen between two thereof. A nozzle 5 moves along the coolant pipe 2 and is about to apply a bead 6 of butyl rubber.

Figure 3:
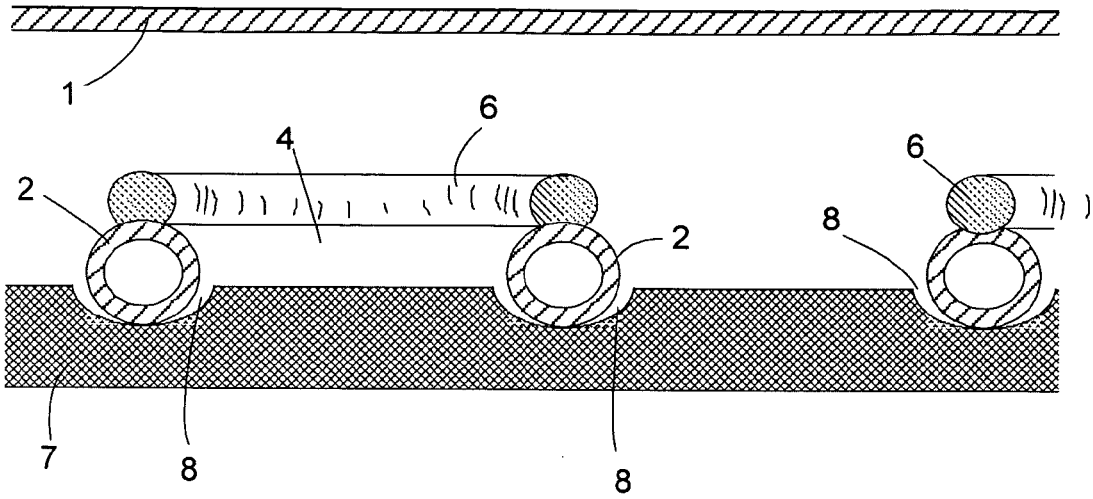

In the stage in FIG. 3 the application of the bead 6 is ended and the coolant pipe 2 together with the bead lies in grooves 8 of a pressing die 7, whose profile is matched to the meander shape of the coolant pipe 2. The cross-sectional shape of the grooves 8 approximately corresponds to half of an ellipse, the cross-sectional area of the complete ellipse corresponding to that of the coolant pipe 2.

Figure 4:
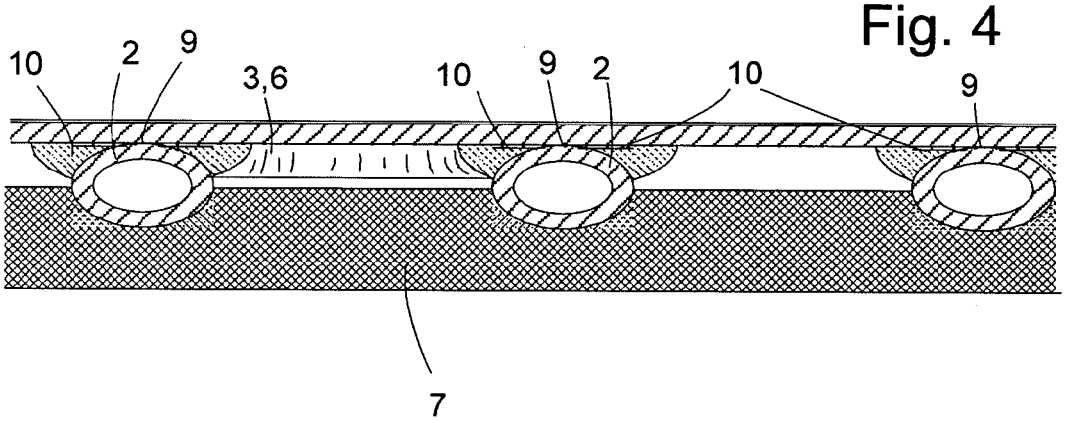

FIG. 4 shows the evaporator after compressing blank 1, bead 6 and coolant pipe 2 between the pressing die 7 and a pressing stamp, not shown which is pressed from above against the blank 1. As a result of the pressing pressure, the cross-section of the coolant pipe 2 is flattened to an ellipse which fills the cross-section of the groove 8. The rubber of the bead 6 is expelled in the lateral direction so that blank 1 and coolant pipe 2 come into direct contact in a narrow strip-shaped contact zone 9 extending over the entire length of the coolant pipe 2. Gussets 10 formed between the blank 1 and the pipe 2 on both sides of the contact zone 9 are filled with the rubber 3 of the bead 6 and thus form two rubber strips which extend to the right and to the left of the coolant pipe 2 over its entire length.

Figure 5:
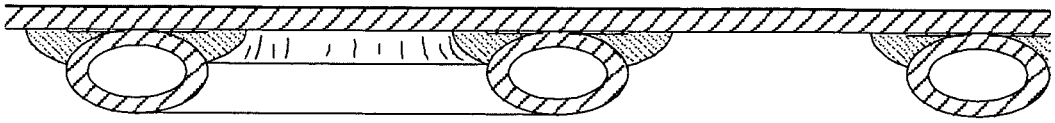

FIG. 5 shows the finished evaporator after removal from the pressing die 7.

The butyl rubber creates a secure loadable bond between blank 1 and coolant pipe 2. The high thermal conductivity of the rubber compared to other sealing or adhesive materials also allows efficient heat exchange between those surface regions of blank 1 and pipe 2 which are not in direct contact with one another. Since the gussets between the blank 1 and pipe 2 are free from air inclusions, the cooling performance of the evaporator according to the invention is exactly reproducible.

The invention claimed is:

1. A heat exchanger for a refrigerator, the heat exchanger comprising:

a blank;

a coolant pipe; and two strips of adhesive which join the coolant pipe to the blank, wherein a first one of the two strips of adhesive extends along one side of the coolant pipe and a second one of the two strips of adhesive extends along a different side of the coolant pipe, the coolant pipe is in direct contact with the blank in between the first strip and the second strip, and wherein the first and second strips are free from air inclusions.

2. The heat exchanger according to claim 1, wherein the coolant pipe has a flattened portion in its cross-section.

3. The heat exchanger according to claim 1, wherein the adhesive is a butyl rubber.

4. The heat exchanger according to claim 1, wherein the heat exchanger includes at least one of an evaporator and a liquefier.

5. The heat exchanger according to claim 2, wherein the flattened portion of the cross-section of the coolant pipe is in direct contact with the blank.

6. The heat exchanger according to claim 5, wherein the first and second strips are immediately adjacent to the flattened portion.

7. A method for producing a heat exchanger comprising the acts of:

a) preparing a coolant pipe and a blank;

b) placing a bead of a plastic adhesive having a profile matched to a profile of the coolant pipe between the coolant pipe and the blank; and c) compressing the bead between the coolant pipe and the blank, wherein the bead adhesive is free from air inclusions after it is compressed between the coolant pipe and the blank.

8. The method according to claim 7, wherein the act b) includes the adhesive being applied to the coolant pipe.

9. The method according to claim 7, wherein the act a) includes bending the coolant pipe is in a meander shape.

10. The method according to claim 7, wherein the act c) includes the coolant pipe having a flattened shape.

11. The method according to claim 7, wherein the adhesive is a butyl rubber.

12. The method according to claim 7, wherein the heat exchanger includes at least one of an evaporator and a liquefier.

13. The method according to claim 7, further comprising:

(d) removing the pipe and the blank from a press in which the bead is compressed in act (c) immediately after the bead is compressed.

14. The method according to claim 13, wherein the act (c) causes the coolant pipe to come into direct contact with the blank.

15. The method according to claim 14, wherein the bead of plastic adhesive has a width that is less than a width of the coolant pipe.

16. The method according to claim 7, wherein the act (c) causes the coolant pipe to come into direct contact with the blank.

17. The method according to claim 7, wherein the bead of plastic adhesive has a width that is less than a width of the coolant pipe.

* * * * *